US006457487B1

(12) United States Patent
Stephenson et al.

(10) Patent No.: US 6,457,487 B1
(45) Date of Patent: Oct. 1, 2002

(54) HYDRAULIC SYSTEM WITH THREE ELECTROHYDRAULIC VALVES FOR CONTROLLING FLUID FLOW TO A LOAD

(75) Inventors: Dwight B. Stephenson, Delafield, WI (US); Joseph Lawrence Pfaff, Wauwatosa, WI (US)

(73) Assignee: Husco International, Inc., Waukesha, WI (US)

( * ) Notice: Subject to any disclaimer, the term of this patent is extended or adjusted under 35 U.S.C. 154(b) by 0 days.

(21) Appl. No.: 09/847,504

(22) Filed: May 2, 2001

(51) Int. Cl.[7] ..... F15B 13/043

(52) U.S. Cl. ..... 137/596.16; 91/447; 91/448; 91/459; 91/464; 137/596.17

(58) Field of Search ..... 91/447, 448, 459, 91/464; 137/596.16, 596.17

(56) References Cited

U.S. PATENT DOCUMENTS 4,058,139 A * 11/1977 Budzich ..... 91/446
5,036,877 A 8/1991 Distler et al.
5,072,752 A 12/1991 Kolchinsky
5,143,115 A 9/1992 Geyler, Jr.
5,174,544 A 12/1992 Emanie
5,207,059 A * 5/1993 Schexnayder ..... 91/448
5,878,647 A 3/1999 Wilke et al.
6,149,124 A 11/2000 Yang
6,161,467 A * 12/2000 A'Hearn et al. ..... 91/447
6,173,639 B1 * 1/2001 A'Hearn et al. ..... 91/447
6,186,044 B1 * 2/2001 Hajek et al. ..... 91/447
6,328,275 B1 * 12/2001 Yang et al. ..... 251/30.03

* cited by examiner

*Primary Examiner*—Gerald A. Michalsky
(74) *Attorney, Agent, or Firm*—George E. Haas; Quarles & Brady LLP

(57) ABSTRACT

An assembly of a pair of electrically operated bidirectional proportional control valves and a four-way direction control valve governs the flow of fluid to and from a hydraulic cylinder. The four-way direction control valve alternately connects a pump supply line to one of a pair of intermediate conduits and a tank return line to the other intermediate conduit. That connection determines the direction of movement of the cylinder piston. The intermediate conduits are coupled to chambers of the cylinder by a separate one of the proportional control valves which meters the fluid flow to or from the respective chamber. Thus the proportional control valves control the rate of piston movement.

12 Claims, 3 Drawing Sheets

HYDRAULIC SYSTEM WITH THREE ELECTROHYDRAULIC VALVES FOR CONTROLLING FLUID FLOW TO A LOAD

BACKGROUND OF THE INVENTION

1. Field of the Invention

The present invention relates to valve assemblies that control the flow of fluid to a hydraulic load, such as a cylinder and piston combination; and more particularly to such assemblies that incorporate electrohydraulic valves.

2. Description of the Related Art

A wide variety of machines have working members that are driven by hydraulic motors, such as cylinder and piston assemblies. Each cylinder is divided into two internal chambers by the piston and selective application of hydraulic fluid under pressure to either of the chambers moves the piston in a corresponding direction. While that action is occurring, fluid is being drained, or exhausted, from the other cylinder chamber to a tank for the hydraulic system.

Traditionally the flow of hydraulic fluid to and from the cylinder was controlled by a manually operated valve, such as the one described in U.S. Pat. No. 5,579,642. There is a trend away from manually operated hydraulic valves toward electrohydraulic valves which are electrically controlled. This change in technology facilitates computerized regulation of various machine functions. Electrical control also simplifies the plumbing of the hydraulic system, as the control valves can be located near each cylinder and not at the operator station. Thus only a single pair of pump and tank lines needs to be run to the hydraulic actuators throughout the machine. Although separate electrical wires may have to be run to each valve, those wires are easier to run and maintain as compared to hydraulic lines.

U.S. Pat. No. 6,073,652 describes an electrohydraulic valve assembly which utilizes four solenoid operated proportional control valves. One pair of valves controls the flow of fluid to and from one of the cylinder chambers, while the other pair of valves controls the flow of fluid to and from the other cylinder chamber. In each pair, one valve regulates the flow of hydraulic fluid from the pump supply line to the associated cylinder chamber and the other valve of the pair controls the flow of hydraulic fluid from that chamber to the system tank. Therefore the cylinder is operated by activating one valve in each pair to apply pressurized fluid to one chamber of the cylinder and drain the fluid from the other chamber. The particular combination of electrohydraulic valves that are activated determines the direction in which the piston is driven.

One drawback of this type of assembly is that four electrohydraulic proportional valves are required to produce bidirectional movement of the piston.

SUMMARY OF THE INVENTION

The present invention provides a control valve assembly that utilizes three electrohydraulic valves to control the flow of fluid between a hydraulic motor and both a source and a tank.

That valve assembly includes a fluid supply line for receiving pressurized hydraulic fluid from the source and a return line for connection to the tank. A first intermediate conduit and a second intermediate conduit also are provided.

The valve assembly has first and second work ports for connection to the hydraulic motor, which may be a cylinder and piston assembly for example.

A direction control valve is connected to the fluid supply line, the return line and the first and second intermediate conduits, and is selectively operated between first and second positions by an electrical control signal.

The first and second positions provide different fluid paths between the supply and return lines and the first and second intermediate conduits. In one preferred embodiment, the fluid supply line is coupled to the first intermediate conduit and the return line coupled to the second intermediate conduit when the direction control valve is in the first position, and the fluid supply line is coupled to the second intermediate conduit and the return line coupled to the first intermediate conduit when the direction control valve is in the second position. Another embodiment of the direction control valve has a position in which regeneration occurs where fluid draining from the motor into one work port is supplied to the other work port.

A bidirectional first control proportional valve is connected between the first intermediate conduit and the first work port to control a flow of hydraulic fluid there between. A bidirectional second proportional control valve control the flow of hydraulic fluid between the second intermediate conduit and the second work port.

The direction control valve is operated to determine into which work port pressurized fluid from the source is supplied and from which work port fluid is exhausted. This determines the direction in which the motor operates. The first and second proportional control valves operate to meter the flow of hydraulic fluid to and from the work ports and thus control the rate of movement of the motor. Therefore, the present assembly of three valves achieves the same degree of control over the operation of the motor as prior assemblies having four proportional valves.

DETAILED DESCRIPTION OF THE INVENTION

Figure 1:
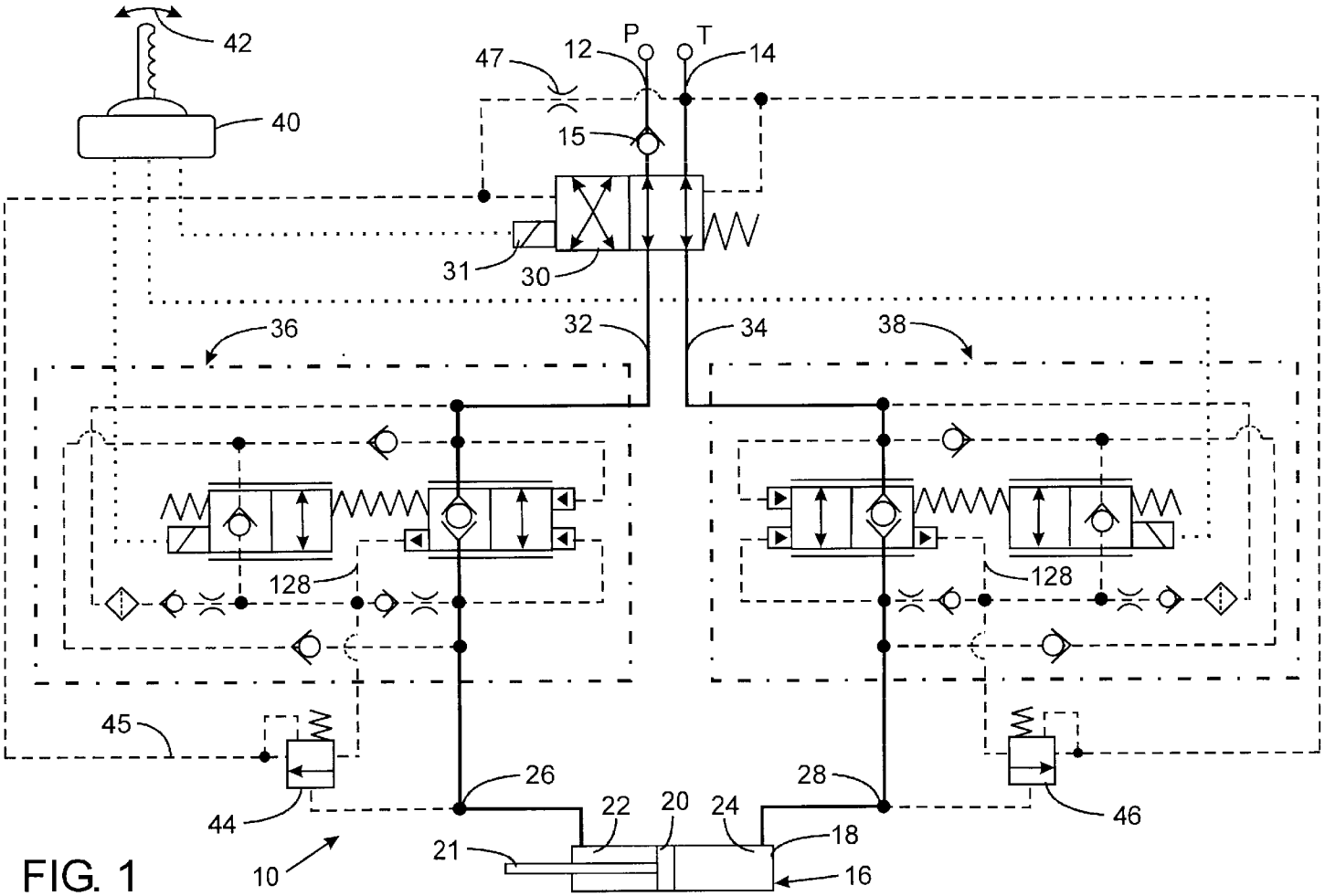
FIG. 1 is a schematic diagram of a hydraulic circuit which incorporates the present invention.

With reference to FIG. 1, a hydraulic circuit 10 has a supply line 12 at which pressurized fluid is received from a source, such as a pump. The pump, for example, operates in a high standby pressure mode. A tank return line 14 is provided for connection to a hydraulic system tank. The hydraulic circuit 10 controls the flow of fluid between the supply and tank return lines 12 and 14 and a hydraulic motor 16, such as a combination of a cylinder 18 and a piston 20. The term motor as used herein generically refers any device that converts hydraulic pressure into mechanical force.

The supply line 12 and tank return line 14 are connected to a four-way direction control valve 30 which is placed into one of two positions by a solenoid 31 and a return spring. A check valve 15 is provided between the supply line 12 and the direction control valve 30 to prevent back flow of hydraulic fluid from the direction control valve into the fluid supply line. If the force of the load that is driven by the piston 20 exceeds the force produced by the supply line pressure at the cylinder 18, the check valve 15 closes preventing the load force from moving the piston 20.

The direction control valve 30 has two positions in which different connections of the supply line 12 and tank return line 14 are provided to first and second intermediate conduits 32 and 34. In a first position, the supply line 12 is coupled to the first intermediate conduit 32 and the return line 14 is connected to the second intermediate conduit 34; and in the second position, the fluid supply line 12 is coupled to the second intermediate conduit 34 and the return line 14 connects to the first intermediate conduit 32.

The first and second intermediate conduits 32 and 34 are respectively connected to first and second bidirectional, proportional control valves 36 and 38. The first and second proportional control valves 36 and 38 are operated by separate electric solenoids to meter the flow of fluid to and from first and second work ports 26 and 28, respectively. The cylinder 18 has a rod chamber 22 that is connected to the first work port 26 and has a head chamber 24 connected to the second work port 28.

Figure 2:
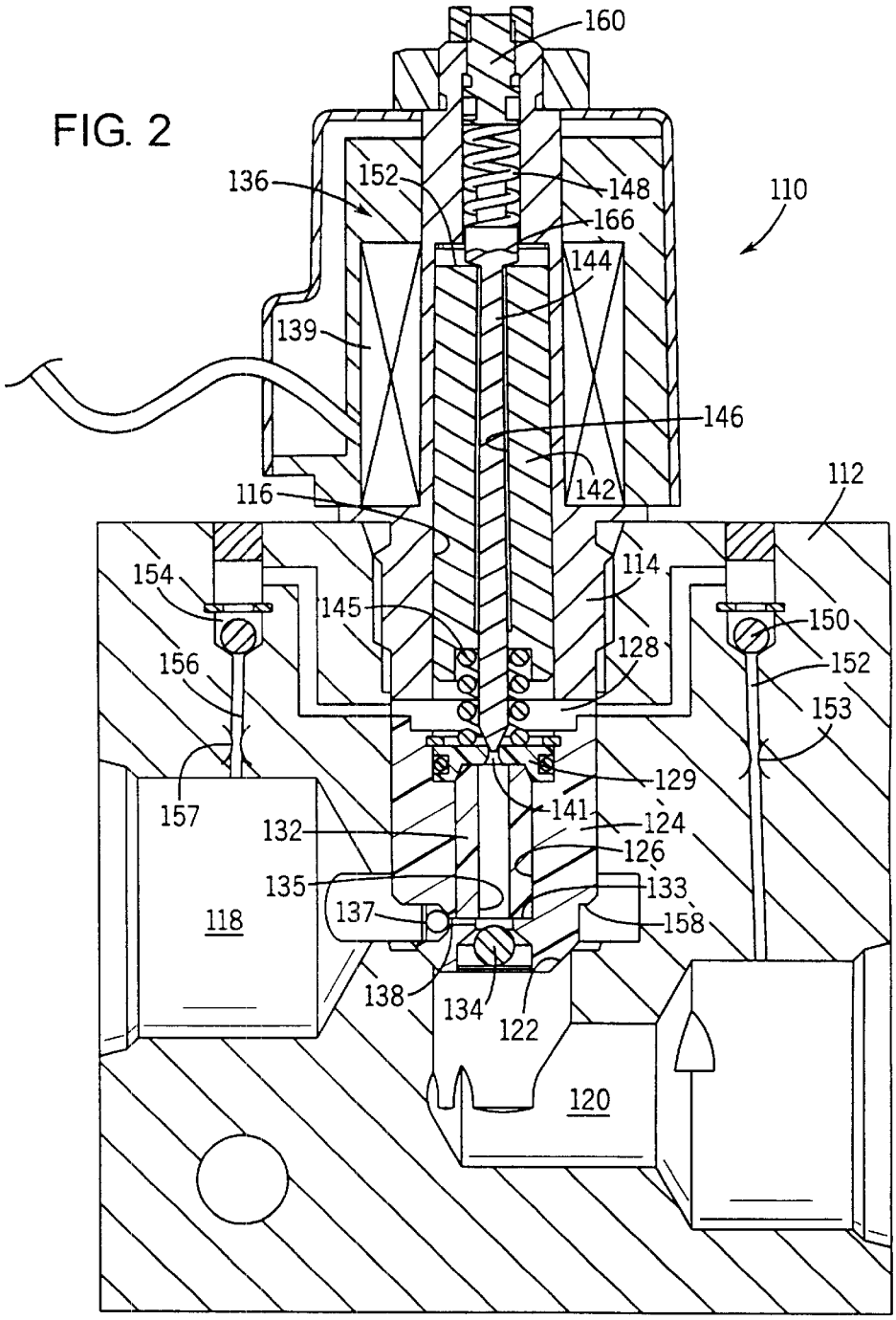
FIG. 2 is a cross sectional view of a bidirectional proportional control valve that is used in the hydraulic circuit.

FIG. 2 illustrates the details of the bidirectional, proportional control valves 36 and 38 used in the hydraulic system 10. The exemplary proportional control valve 110 comprises a cylindrical valve cartridge 114 mounted in a longitudinal bore 116 of a valve body 112. The valve body 112 has a transverse first port 118 which communicates with the longitudinal bore 116. An second port 120 extends through the valve body and communicates with an interior end of the longitudinal bore 116. A valve seat 122 is formed between the first and second ports 118 and 120.

A main valve poppet 124 slides within the longitudinal bore 116 with respect to the valve seat 122 to selectively control flow of hydraulic fluid between the first and second ports. A central bore 126 is formed in the main valve poppet 124 and extends from an opening at the second port 120 to a second opening into a control chamber 128 on the remote side of the main valve poppet. The central bore 126 has a shoulder 133 spaced from the first end that opens into the second port 120. A first check valve 134 is located in the main valve poppet between the shoulder 133 and the first opening to allow fluid to flow only from the poppet's central bore 126 into the second port 120.

A second check valve 137 is located within the main valve poppet 124 in a passage 138 that extends between the first port 118 and the central bore 126 adjacent to the shoulder 133. The second check valve 137 limits fluid flow in the passage 138 to only a direction from the poppet bore 126 to the first port.

The second opening of the bore 126 in the main valve poppet 124 is closed by a flexible seat 129 with a pilot aperture 141 extending there through. A resilient tubular column 132, within the central bore 126, biases the flexible seat 129 with respect to the shoulder 133. Opposite sides of the flexible seat 129 are exposed to the pressures in the control chamber 128 and in a pilot passage 135 formed in the main valve poppet 124 by the tubular column 132.

The valve body 112 incorporates a third check valve 150 in a passage 152 extending between the control chamber 128 and the second port 120. The third check valve 150 allows fluid to flow only from the second port 120 into the control chamber 128. A fourth check valve 154 is located in another passage 156 to allow fluid to flow only from the first port 118 to the control chamber 128. Both of these check valve passages 152 and 156 have a flow restricting orifice 153 and 157, respectively.

Movement of the main valve poppet 124 is controlled by a solenoid 136 comprising an electromagnetic coil 139, an armature 142 and a pilot poppet 144. The armature 142 is positioned within a bore 116 through the cartridge 114 and a first spring 145 biases the main valve poppet 124 away from the armature. The electromagnetic coil 139 is located around and secured to cartridge 114. The armature 142 slides within the cartridge bore 116 away from main valve poppet 124 in response to an electromagnetic field created by applying electric current to the electromagnetic coil 139. The pilot poppet 144 is located within a bore 146 of the tubular armature 142 and is biased into the armature by a second spring 148 that engages an adjusting screw 160.

In the de-energized state of the electromagnetic coil 139, the second spring 148 forces the pilot poppet 144 against end 152 of the armature 142, pushing both the armature and the pilot poppet toward the main valve poppet 124. This results in a conical tip of the pilot poppet 144 entering and closing the pilot aperture 141 in the resilient seat 129 and the pilot passage 135, thereby closing fluid communication between the control chamber 128 and the second port 120.

The control valve 110 proportionally meters the flow of hydraulic fluid between the first and second ports 118 and 120. The electric current generates an electromagnetic field which draws the armature 142 into the solenoid 136 and away from the main valve poppet 124. The magnitude of that electric current determines the amount that the valve opens and the rate of hydraulic fluid flow through the valve is proportional to that current. Specifically, when the pressure at the first port 118 exceeds the pressure at the pressure at second port 120, the higher pressure is communicated to the control chamber 128 through the fourth check valve 154. As the armature 142 moves, head 166 on the pilot poppet 144 is forced away from the main valve poppet 124 opening the pilot aperture 141. That action results in hydraulic fluid flowing from the first port 118 through the control chamber 128, pilot passage 135 and the first check valve 134 to the second port 120.

The flow of hydraulic fluid through the pilot passage 135 reduces the pressure in the control chamber 128 to that of the second port 120. Thus the higher pressure in the first port 118 that is applied to the surface 158 forces main valve poppet 124 away from valve seat 122 thereby opening direct communication between the first port 118 and second port 120. Movement of the main valve poppet 124 continues until a pressure of force balance is established across the main poppet 124 due to constant flow through the orifice 157 and the effective orifice of the pilot opening to the pilot aperture 141. Thus, the size of this valve opening and the flow rate of hydraulic fluid there through are determined by the position of the armature 142 and pilot poppet 144. Those positions are in turn controlled by the magnitude of current flowing through electromagnetic coil 139.

When the pressure in the second port 120 exceeds the pressure in the inlet port 118,. proportional flow from the outlet port to the inlet port can be obtained activating the solenoid 136. In this case the higher second port pressure is communicated through the third check valve 154 to the control chamber 128 and when the pilot poppet 144 moves away from the pilot seat 129 fluid flows from the control chamber, pilot passage 135 and second check valve 137 to the first port 118. This results in the main valve poppet 124 opening due to the higher pressure acting on its bottom surface.

Referring again to FIG. 1, the control chamber 128 of each proportional control valve 36 and 38 is connected to a pressure relief valve 44 or 46. Both of these relief valves 44 and 46 are referenced to the pressure in the tank return line 14 and to pressure at the respective work port 26 or 28.

Thus, the relief valve 44 or 46 opens when the respective work port pressure is excessively high, thereby relieving the pressure in the control chamber 128 of the associated proportional control valve 36 or 38, causing that control valve to open.

When relief valve 44 opens, the flow to tank through a relief conduit 45 is restricted by an orifice 47. As a result pressure is applied to one side of the four-way direction control valve 30 which causes that valve to move to the opposite position to that illustrated in FIG. 1. This opens a high flow path from the first proportional control valve 36 to tank thereby rapidly relieving that excess pressure which caused the relief valve 44 to open.

The solenoid coil 139 of each of the proportional control valves 36 and 38, and the solenoid 31 of the four-way direction control valve 30 are controlled by signals from a joy stick 40 which can be manipulated by an operator of the machine on which the hydraulic circuit 10 is incorporated. The joystick can be moved in opposite directions along an axis indicated by double arrows 42. In this case, the pump which furnished hydraulic fluid to the supply line 12 will be in a high standby pressure mode.

For example, movement of the joystick handle to the right in the drawing indicates a desire that the piston rod 21 be retracted into cylinder 18, which requires that pressurized fluid from the supply line 12 be applied via the first intermediate conduit 32 to the rod chamber 22 of cylinder. The second intermediate conduit 34 is coupled to the return line 14 in this first position of the direction control valve 30. Note that the four-way direction control valve 30 is biased by its spring into the first position to achieve this flow pattern without electrically activating the solenoid 31. The amount of movement of the joystick 40 from the center position indicates the desired rate at which the piston is to move, and thus the amount that each proportional control valve 36 and 38 should be opened. Therefore, the greater that joystick motion, the greater the level of current that is applied to the solenoid coils 139 of the proportional control valves 36 and 38. The resultant operation of the proportional control valves 36 and 38 meters the flow of fluid between the intermediate conduits 32 and 34 and the respective work ports 26 and 28.

Alternatively, movement of the joystick handle to the left in the drawing indicates that the piston rod 21 is to be extended from the cylinder 18, for example, which requires that fluid from the supply line 12 be applied to the cylinder head chamber 24. Therefore, this operation of the joystick sends a signal to the solenoid 31 of the direction control valve 30 which switches the position of the valve from that illustrated in FIG. 1. In the resultant second position, the supply line 12 is connected to the second intermediate conduit 34 and the first intermediate conduit 32 is connected to the return line 14. The amount of joystick movement controls the degree to which the proportional control valve 36 and 38 are opened, as described previously with respect to movement in the opposite direction.

As a result, the solenoid operated direction control valve 30 determines the direction of movement of the piston 20 within the cylinder 18 by channeling fluid from the supply line 12 to the proper cylinder chamber 22 or 24. At the same time, the direction control valve 30 provides a path for fluid from the other cylinder chamber 24 or 22 to flow to the tank line 14. Operation of the bidirectional, proportional control valves 36 and 38 meters the hydraulic fluid into and out of the cylinder chambers 22 and 24 thus controlling the rate of piston movement.

Figure 3:
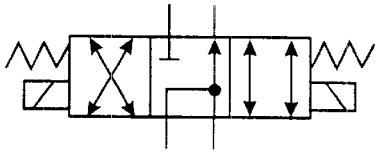
FIG. 3 is a second embodiment of a direction control valve used in the hydraulic circuit of FIG. 1.

FIG. 3 illustrates a three-position direction control valve 50 that has a center float position 52 in which the first and second intermediate conduits are both connected to the return line 14. The three-position direction control valve 50 is driven into the rod retract and extend positions by a pair of solenoids.

Figure 4:
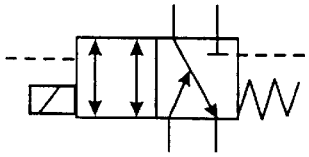
FIG. 4 is a third embodiment of the direction control valve.

FIG. 4 illustrates an alternative type of direction control valve 60 for use in place of the direction control valve 30 in FIG. 1. This direction control valve 60 provides a regeneration function in which, when the piston rod is being extended, the fluid being exhausted from the cylinder rod chamber 22 is directed into the head chamber 24 instead of draining to the tank return line 14. Thus less fluid from the supply line 12 is required in this operating mode. The larger piston surface area in the head chamber 24, than in the rod chamber 22, causes the piston to move in the direction that extends the rod 21 from the cylinder 18.

It should be understood that other variations of the direction control valve 30 are possible. For example, the regeneration section of the valve in FIG. 4 could be used in place of one of the outer sections of the valve in FIG. 3. Likewise, the float section of the FIG. 3 could be used in place of a section of the direction control valve 30 in FIG. 1 where that section is used to lower a load by the force of gravity alone, as in a fork lift.

Instead of operating the valves 30, 36 and 38 directly by the joystick 40 as shown in FIG. 1, the joystick 40 can be connected to inputs of microcomputer based controller.

Other inputs to the controller receive signals from pressure sensors located in the supply and tank return lines 12 and 14 and at each work port 26 and 28. In this embodiment, the solenoids of valves 30, 36 and 38 are operated by output signals from the controller. The controller governs the degree to which the proportional control valves 36 and 38 open in response to the sensed pressures to provide the desired fluid flow so that the cylinder 18 is operated in a controlled manner.

Figure 5:
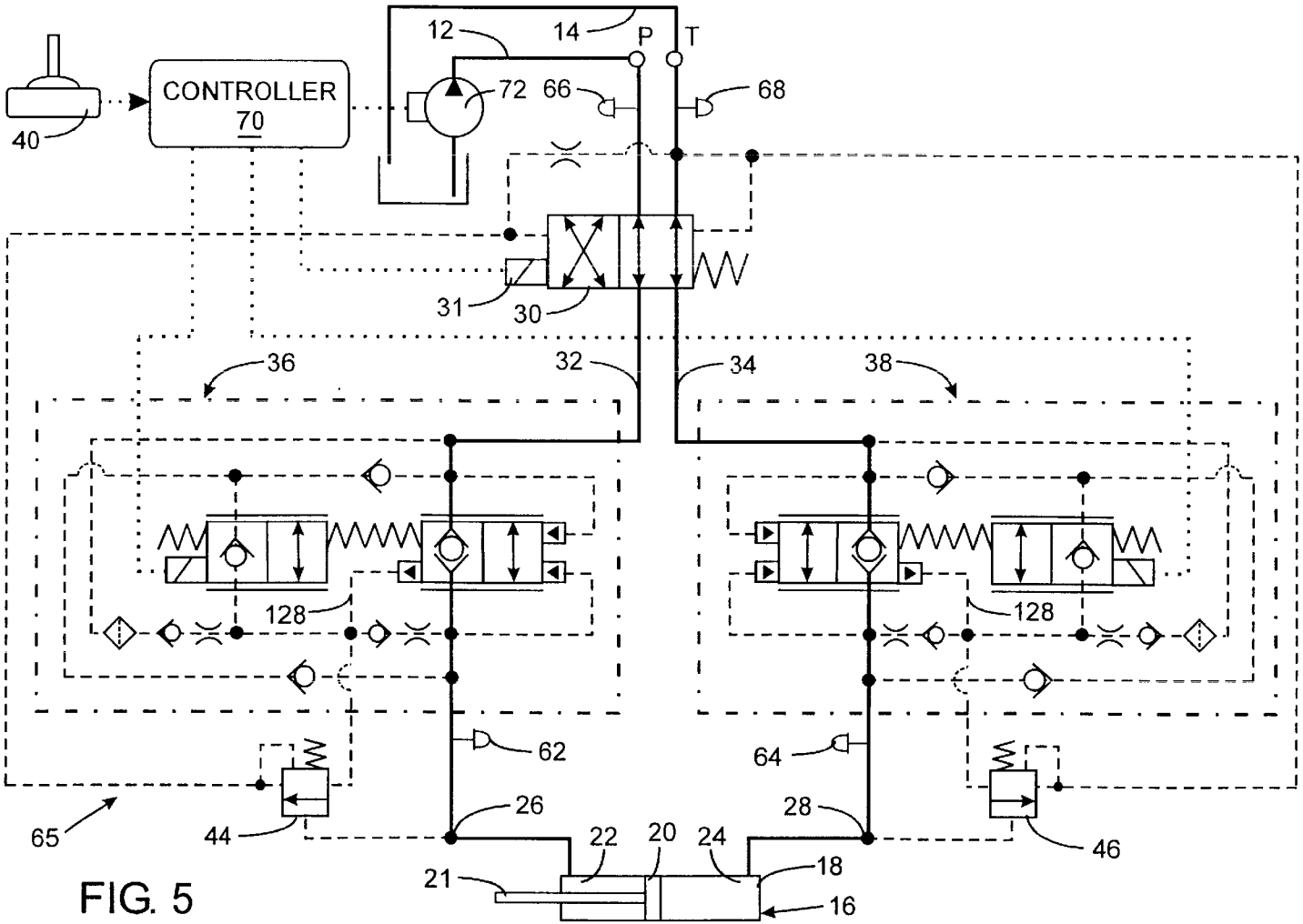
FIG. 5 is a schematic diagram of another hydraulic circuit incorporating the present invention.

With reference to FIG. 5, an alternative hydraulic circuit 65 which receives fluid from a variable displacement pump 72 operated by a controller 70. In this circuit 65, components that are identical to those of circuit 10 in FIG. 1 have been assigned identical reference numerals. The latter circuit 65 further comprises sensors that measure the pressure at key locations and provide signals indicating that pressure to the controller 70. A first pressure sensor 62 is located at the first work port 26 and a second pressure sensor 64 is located at the second work port 28. Another pair of sensors 66 and 68 detect the pressures in the supply and tank lines 12 and 14, respectively.

The controller 70 receives the sensor signals along with signals from the joystick 40. When the joystick signals indicated a particular operation of the hydraulic motor 16 is desired, the controller responds by operating the valves as describes with respect to hydraulic circuit 10. As the valves open, the controller monitors the pressures indicated by the sensors 62, 64, 66 and 68 and control the displacement of the pump 72 so that the supply line pressure is sufficient to power the motor .16 depending upon the load on the motor.

Note that the hydraulic circuit in FIG. 5 does not have a check valve in the pump supply line 12 at the input to the four-way direction control valve 30. The function provided by that valve 15 in FIG. 1, preventing a high load pressure from forcing fluid backwards into the pump supply line 12, is preformed by the controller 70 in response to the signals from the pressure sensors 66, 62 and 64. Specifically, when the signals from those pressure sensors indicate that the pressure at the work port 26 or 28 that is connected to the supply line is greater than the supply line pressure, the controller closes the associated bidirectional, proportional control valves 36 or 38. That action prevents the reverse flow of fluid through the valve assembly.

What is claimed is:

1. A valve assembly for controlling a hydraulic motor, that valve assembly comprising:

a fluid supply line for receiving pressurized hydraulic fluid;

a return line for connection to a tank;

a first intermediate conduit and a second intermediate conduit;

a first work port and a second work port for connection to the hydraulic motor;

a direction control valve coupled to the fluid supply line and the return line, and having a first position and a second position which provide different fluid paths between the fluid supply line and the return line and the first and second intermediate conduits a bidirectional first proportional control valve connected between the first intermediate conduit and the first work port to control a flow of hydraulic fluid there between, the first proportional control valve comprises a pilot operated valve having a pilot valve element and a main valve element with a control chamber formed on one side of the main valve element;

a bidirectional second proportional control valve connected between the second intermediate conduit and the second work port to control a flow of hydraulic fluid there between, the second proportional control valve comprises a pilot operated valve having a pilot valve element and a main valve element with a control chamber formed on one side of the main valve element;

a first pressure relief valve which connects the control chamber of the first proportional control valve to the return line in response to pressure at the first work port exceeding pressure in the return line by a first predefined amount; and a second pressure relief valve which connects the control chamber of the second proportional control valve to the return line in response to pressure at the second work port exceeding pressure in the return line by a second predefined amount.

2. The valve assembly as recited in claim 1 further comprising a check valve coupling the fluid supply line to the direction control valve and preventing flow of hydraulic fluid from the direction control valve into the fluid supply line.

3. The valve assembly as recited in claim 1 wherein in the first position of the direction control valve the fluid supply line is coupled to the first intermediate conduit and the return line is coupled to the second intermediate conduit, and in the second position the fluid supply line is coupled to the second intermediate conduit and the return line is coupled to the first intermediate conduit.

4. The valve assembly as recited in claim 3 wherein the direction control valve has a third position in which both the first intermediate conduit and the second intermediate conduit are connected to the return line.

5. The valve assembly as recited in claim 1 wherein in the first position of the direction control valve the fluid supply line is coupled to the first intermediate conduit and the return line is coupled to the second intermediate conduit, and in the second position the fluid supply line is connected to both the first intermediate conduit and the second intermediate conduit.

6. The valve assembly as recited in claim 1, further comprising:

a relief conduit connected to the first pressure relief valve and to the direction control valve; and an orifice coupling the relief conduit to the return line, wherein pressure above a predefined level in the relief conduit shifts the control valve into a position in which the first intermediate conduit is connected to the return line.

7. A valve assembly for controlling a hydraulic motor, that valve assembly comprising:

a fluid supply line for receiving pressurized hydraulic fluid;

a return line for connection to a tank;

a first intermediate conduit and a second intermediate conduit;

a first work port and a second work port for connection to the hydraulic motor;

a direction control valve coupled to the fluid supply line and the return line, and having a first position and a second position which provide different fluid paths between the fluid supply line and the return line and the first and second intermediate conduits a bidirectional first proportional control valve connected between the first intermediate conduit and the first work- port to control a flow of hydraulic fluid there between; and a bidirectional second proportional control valve connected between the second intermediate conduit and the second work port to control a flow of hydraulic fluid there between;

wherein each of the first proportional -control valve and the second proportional control valve comprises:

a first port and a second port through which fluid enters and leaves the proportional control valve;

a valve seat formed between the first port and the second port;

a main poppet selectively engaging the valve seat to control flow of fluid between the first port and the second port, and forming a control chamber on a side of the main poppet remote from the valve seat, a pilot passage in the main poppet communicating with the first port, second port and the control chamber;

a first flow control element which allows fluid to flow only from the pilot passage into the second port;

a second check valve which allows fluid to flow only fluid to flow only from the pilot passage into the first port;

a pilot poppet which selectively closes the pilot passage;

an electrically operated actuator operably coupled to move the pilot poppet with respect to the main poppet;

a first passage extending between the control chamber and the second port;

third check valve which allows fluid to flow through the first passage only in the direction from the second port to the control chamber;

a second passage extending between the control chamber and the first port; and a fourth check valve which allows fluid to flow through the second passage only in the direction from the first port to the control chamber.

8. The valve assembly as recited in claim 7 wherein the pilot passage of each of the first proportional control valve and second proportional control valve has an opening into the control chamber; and further comprises a flexible valve seat extending across the opening and having an aperture there through, wherein the pilot poppet engages the flexible valve seat to seal the pilot passage.

9. A valve assembly for controlling a hydraulic motor, that valve assembly comprising:

a fluid supply line for receiving pressurized hydraulic fluid;

a return line for connection to a tank;

a first intermediate conduit and a second intermediate conduit;

a first work port and a second work port for connection to the hydraulic motor;

a direction control valve having a first position and a second position determined by an electrical control signal, in the first position the fluid supply line is coupled to the first intermediate conduit and the return line is coupled to the second intermediate conduit, and in the second position the fluid supply line is coupled to the second intermediate conduit and the return line is coupled to the first intermediate conduit;

a check valve coupling the fluid supply line to the direction control valve and preventing flow of hydraulic fluid from the direction control valve into the fluid supply line;

a bidirectional first proportional control valve connected between the first intermediate conduit and the first work port to control a flow of hydraulic fluid there between; and a bidirectional second proportional control valve connected between the second intermediate conduit and the second work port to control a flow of hydraulic fluid there between;

wherein each of the first proportional control valve and second proportional control valve comprises:

a first port and a second port through which fluid enters and leaves the proportional control valve;

a valve seat formed between the first port and the second port;

a main poppet selectively engaging the valve seat to control flow of fluid between the first port and the second port, and forming a control chamber on a side of the main poppet remote from the valve seat, a pilot passage in the main poppet communicating with the first port, second port and the control chamber;

a first flow control element which allows fluid to flow only from the pilot passage into the second port;

a second check valve which allows fluid to flow only fluid to flow only from the pilot passage into the first port;

a pilot poppet which selectively closes the pilot passage;

an electrically operated actuator operably coupled to move the pilot poppet with respect to the main poppet;

a first passage extending between the control chamber and the second port;

third check valve which allows fluid to flow through the first passage only in the direction from the second port to the control chamber;

a second passage extending between the control chamber and the first port; and a fourth check valve which allows fluid to flow through the second passage only in the direction from the first port to the control chamber.

10. The valve assembly as recited in claim 9 wherein the direction control valve has a third position in which the first intermediate conduit and the second intermediate conduit are both connected to the return line.

11. The valve assembly as recited in claim 9 further comprising:

a first pressure relief valve which connects a control chamber of the first proportional control valve to the return line in response to pressure at the first work port exceeding pressure in the return line by a first predefined amount; and a second pressure relief valve which connects a control chamber of the second proportional control valve to the return line in response to pressure at the second work port exceeding pressure in the return line by a second predefined amount.

12. The valve assemply as recited in claim 9 wherein the pilot passage of each of the first proportional control valve and second proportional control valve has an opening into the control chamber; and further comprises a flexible valve seat extending across the opening and having an aperture there through, wherein the pilot poppet engages the flexible valve seat to seal the pilot passage.

* * * * *